US008485519B2

(12) United States Patent
Sasaki

(10) Patent No.: US 8,485,519 B2
(45) Date of Patent: Jul. 16, 2013

(54) MEDIA SEPARATING AND FEEDING DEVICE AND MEDIA PROCESSING DEVICE

(75) Inventor: Toshiyuki Sasaki, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 296 days.

(21) Appl. No.: 12/217,923

(22) Filed: Jul. 10, 2008

(65) Prior Publication Data

US 2009/0014943 A1 Jan. 15, 2009

(30) Foreign Application Priority Data

Jul. 10, 2007 (JP) ..... 2007-180531

(51) Int. Cl.
*B65H 3/52* (2006.01)

(52) U.S. Cl.
USPC ..... 271/125

(58) Field of Classification Search
USPC ..... 271/121, 122, 124, 125, 126, 149, 271/150, 114, 117, 118
See application file for complete search history.

(56) References Cited

U.S. PATENT DOCUMENTS

| | | | | |
|---|---|---|---|---|
| 5,213,426 | A | 5/1993 | Ewing | |
| 5,419,543 | A * | 5/1995 | Nakamura et al. | 271/9.01 |
| 5,755,435 | A | 5/1998 | Fujiwara | |
| 6,168,146 | B1 | 1/2001 | Komuro et al. | |
| 6,315,284 | B1 | 11/2001 | Komuro et al. | |
| 6,896,254 | B2 * | 5/2005 | Koh et al. | 271/117 |
| 7,766,319 | B2 | 8/2010 | Miyamoto et al. | |
| 7,980,549 | B2 * | 7/2011 | Hamaguchi | 271/118 |
| 2001/0005464 | A1 | 6/2001 | Funada | |

FOREIGN PATENT DOCUMENTS

| | | | |
|---|---|---|---|
| JP | 61-277520 | A | 12/1986 |
| JP | 07-017652 | | 1/1995 |
| JP | 07-242349 | A | 9/1995 |
| JP | 9-58887 | | 3/1997 |
| JP | 11-263460 | A | 9/1999 |
| JP | 2001-171847 | A | 6/2001 |
| JP | 2002-321837 | * | 11/2002 |
| JP | 2003-206042 | | 7/2003 |
| JP | 2004-206362 | | 7/2004 |
| JP | 2004-206362 | A | 7/2004 |
| JP | 2004-338904 | | 12/2004 |

* cited by examiner

*Primary Examiner* — Thomas Morrison
(74) *Attorney, Agent, or Firm* — Nutter McClennen & Fish LLP; John J. Penny, Jr.; Christina M. Sperry

(57) ABSTRACT

A mechanism enables efficiently reducing the size of a check feeding device for separating and feeding checks one at a time. In one embodiment, a check separating and feeding mechanism uses a single drive motor drive to drive a feed roller, pressure member, and separation roller. When the drive motor turns in a second direction, torque is transferred through a second one-way clutch mechanism to both rollers. When the drive motor turns in this direction, the first one-way clutch mechanism disengages the drive motor from the drive power transfer path to the pressure member, and a tension spring pulls the pressure member in the direction pressing the checks to the feed roller. When the drive motor turns in an opposite first direction, the torque of the drive motor returns the pressure member to the standby position, drive power is not transferred to the rollers, and the rollers do not turn.

15 Claims, 9 Drawing Sheets

MEDIA SEPARATING AND FEEDING DEVICE AND MEDIA PROCESSING DEVICE

BACKGROUND OF THE INVENTION

1. Field of Invention

The present invention relates to a media separating and feeding device that separates and feeds checks, printing paper, and other types of sheet media one at a time. The invention also relates to a check processing device, a printer, a scanner, a magnetic reader, or other type of media processing device that incorporates the media separating and feeding device.

2. Description of Related Art

Banks and other financial institutions use check processing devices (also called check readers) to image and read magnetic ink characters from checks, promissory notes, and other check-like negotiable instruments, and to sort the checks based on the acquired information. As electronic check processing has become more common in recent years, the scanned image data and magnetic ink character data is also processed and managed using computers. See, for example, the check reader taught in Japanese Unexamined Patent Appl. Pub. JP-A-2004-206362.

The checks that are conveyed by the feed roller pass between a separation roller and a retard roller. By passing the checks between these rollers, multifed checks are separated so that the checks are conveyed one at a time through the check transportation path.

In order to reduce the size and space requirements of check processing devices, it is also preferable to reduce the size of the drive mechanism for the pressure member and the drive mechanism for the feed roller and retard roller assembled in the check loading unit. More particularly, once the pressure member is driven to the feed roller side after the checks are loaded, the pressure member is held in this position until all of the checks are gone. When the last check has been fed, the pressure member is reset to the original retracted position so that more checks can be loaded. Providing a dedicated drive motor as the drive power source for a pressure member that is moved only at the beginning and end of the check processing operation is not space efficient. In addition, a motor with relatively high torque capacity approximately equal to the drive motor for driving the feed roller and retard roller is required to drive the pressure member because driving the pressure member requires relatively high torque. Providing a dedicated drive motor is thus inefficient in terms of cost as well as space.

SUMMARY OF THE INVENTION

At least one embodiment of the present invention enables reducing the size and the cost of a media separating and feeding device and a media processing device incorporating the media separating and feeding device for separating and feeding checks and other types of sheet media.

A first aspect of at least one embodiment of the invention is a media separating and feeding mechanism having a feed roller for feeding sheet media; a pressure member for pressing the sheet media to the feed roller side; a separation roller for separating and feeding the sheet media fed by the feed roller; a single drive motor for driving the feed roller, separation roller, and pressure member; and a drive power transfer mechanism for transferring torque from the drive motor to the feed roller, separation roller, and pressure member. The drive power transfer mechanism selectively switches between transferring torque to the feed roller and separation roller, and transferring torque to the pressure member, according to the direction of drive motor rotation.

By using a common drive motor, this aspect of at least one embodiment of the invention enables reducing the size of the drive mechanism that drives the pressure member as well as the feed roller and separation roller.

The drive power transfer mechanism includes a first one-way clutch that transfers drive motor torque to the pressure member only when the drive motor turns in a first direction.

By using a one-way clutch and switching the rotational direction of the torque from the single drive motor, a drive power train that transfers power to the pressure member only when the pressure member needs to be moved can be rendered.

Further preferably, the drive power transfer mechanism also has a second one-way clutch that transfers drive motor torque to the feed roller and separation roller only when the drive motor turns in a second direction that is the opposite of the first direction.

This configuration enables driving the feed roller and separation roller to turn only in the direction that advances the sheet media. If the rollers rotate in reverse when the sheet media is in contact with the rollers, the sheet media will be conveyed opposite the normal media transportation direction and may fall out of the media storage unit. By using a one-way clutch, however, the roller can be prevented from turning in reverse and such problems can therefore be prevented.

Further preferably, the first one-way clutch and the second one-way clutch are rendered with a common shaft.

This configuration enables compactly rendering the drive power transfer mechanism including the first one-way clutch and second one-way clutch.

Further preferably, the media separating and feeding mechanism also has an urging member that urges the pressure member toward the feed roller. When the drive motor turns in the second direction, the pressure member is disengaged from the drive power transfer mechanism by the first one-way clutch and is pressed toward the feed roller by the urging force of the urging member, and when the drive motor turns in the first direction, the pressure member is connected to the drive power transfer mechanism by the first one-way clutch and pulled back by the torque of the drive motor in the direction separating from the feed roller.

When the drive motor is stopped, this aspect of at least one embodiment of the invention enables the coercive torque of the drive motor to hold the pressure member in the position separated from the feed roller. Because the first one-way clutch disengages the drive motor from the drive power transfer path to the pressure member when the drive motor turns in the second direction after the sheet media is inserted between the feed roller and pressure member, the pressure member is pressed toward the feed roller by the urging force of the urging member, and the sheet media can be pressed to the feed roller. The sheet media can therefore be separated and advanced to the transportation path. When the drive motor turns in the first direction after feeding the sheet media ends, the second one-way clutch disengages the drive motor from the drive power transfer path to both rollers and the first one-way clutch connects the drive motor to the drive power transfer path to the pressure member. As a result, the drive power from the drive motor pulls the pressure member away from the feed roller and returns the pressure member to the standby position.

Another aspect of at least one embodiment of the invention is a media processing device having a media insertion unit in which sheet media are inserted; a media separating and feeding mechanism for separating and advancing sheet media that are inserted in a group to the media insertion unit; a media transportation path that conveys sheet media fed from the media insertion unit by the media separating and feeding mechanism; and a processing unit that executes at least one of a reading process that reads information from the sheet media conveyed through the transportation path, and a printing process that prints on the sheet media. The media separating and feeding mechanism is the media separating and feeding mechanism described above.

EFFECT OF THE INVENTION

The media separating and feeding mechanism according to at least one embodiment of the present invention uses a single drive motor to drive a pressure member, a feed roller, and a separation roller. A small, low cost drive mechanism can thus be achieved.

The drive power transfer mechanism of at least one embodiment of the invention uses a one-way clutch mechanism. The one-way clutch mechanism can be assembled coaxially to a gear used in the drive power transfer mechanism. The drive power transfer path can also be switched by simply changing the direction of drive motor rotation. Because the drive power transfer mechanism can thus be rendered small and compact, little installation space is required and device size can be reduced.

Furthermore, by using a one-way clutch to prevent the rollers from turning in reverse, the rollers will not cause the sheet media to move in the reverse direction out of the media insertion unit, and can therefore be prevented from falling out of the media insertion unit.

Other objects and attainments together with a fuller understanding of at least one embodiment of the invention will become apparent and appreciated by referring to the following description and claims taken in conjunction with the accompanying drawings.

DESCRIPTION OF PREFERRED EMBODIMENTS

A preferred embodiment of a check processing device having the media separating and feeding device according to at least one embodiment of the present invention is described below with reference to the accompanying figures.

Figure 1:
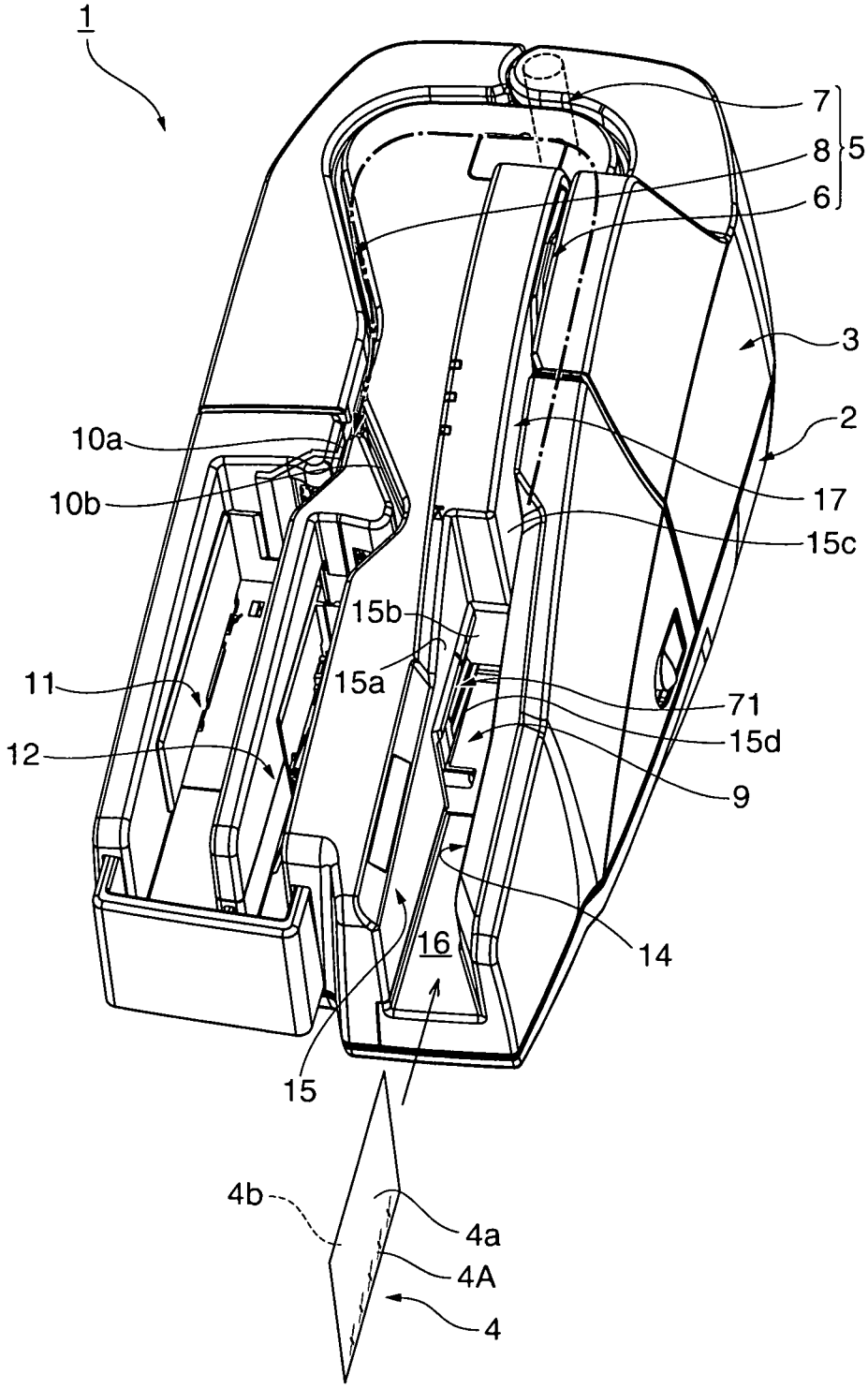
FIG. 1 is an external oblique view of a check processing device according to at least one embodiment of the invention.
Figure 2:
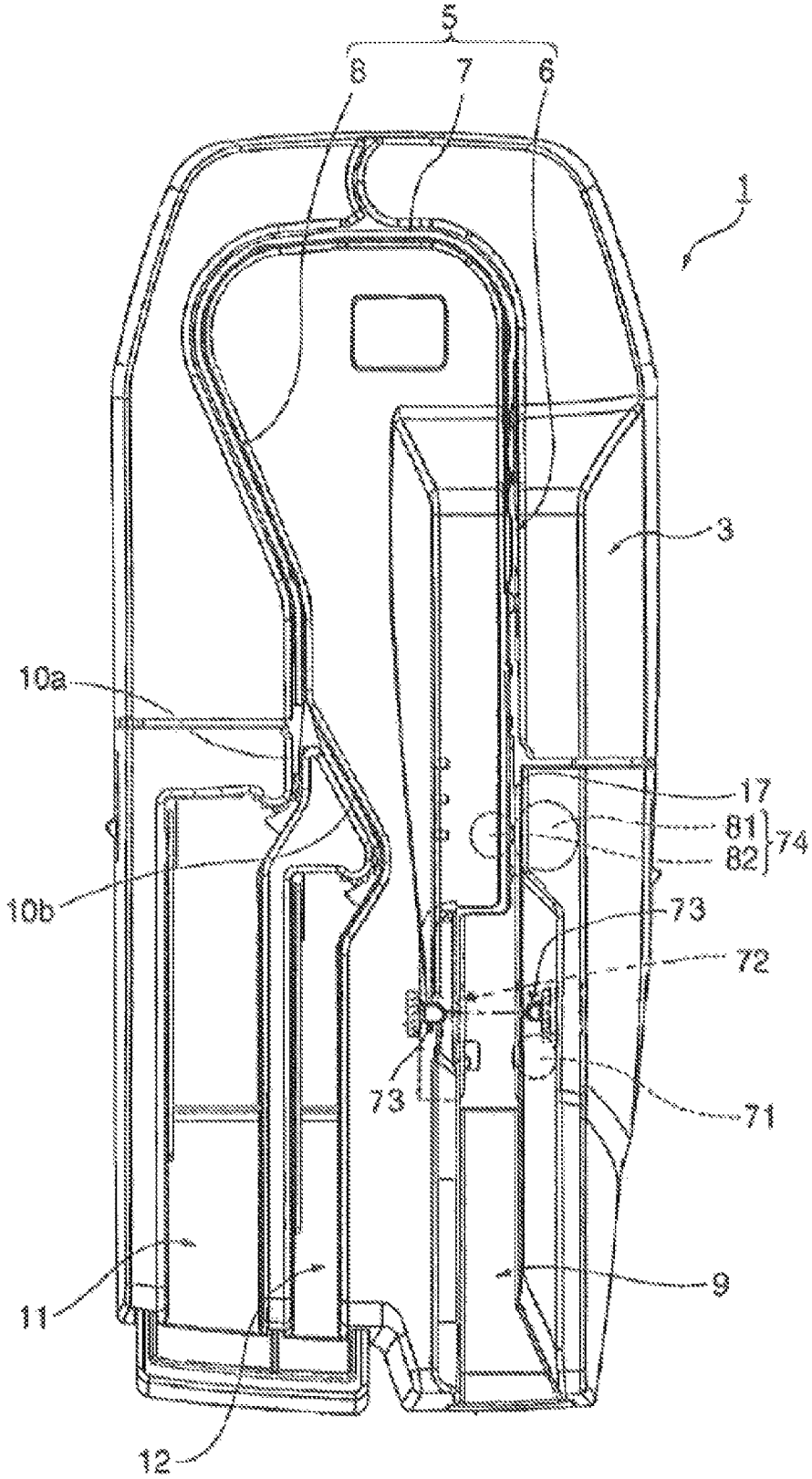
FIG. 2 is a plan view of the check processing device shown in FIG. 1.

FIG. 1 is an external oblique view of a check processing device 1 according to at least one embodiment of the invention, and FIG. 2 is a plan view of the same. This check processing device 1 has a bottom case 2 and a top case 3 that covers the top of the bottom case 2, and various parts and assemblies are disposed inside the cases. A check transportation path 5 for conveying checks 4 (sheet media) is formed in the top case 3.

The check transportation path 5 is a narrow vertical slot that curves in a basically U-shaped configuration when seen from above, and includes a straight upstream-side transportation path portion 6, a curved transportation path portion 7 that continues from the upstream-side transportation path portion 6, and a slightly curving downstream-side transportation path portion 8 that continues from the curved transportation path portion 7.

The upstream end of the upstream-side transportation path portion 6 communicates with a check loading unit 9, which is a wide vertical slot. The downstream end of the downstream-side transportation path portion 8 is connected through left and right diversion paths 10*a*, 10*b* to first and second check discharge units 11 and 12, which are wide vertical slots.

As shown in FIG. 1, the checks 4 that are read have an MICR line 4A printed along the bottom edge on the front 4*a* of the check 4. Also recorded on the front 4*a* against a patterned background are the check amount, payer and payee, various numbers, and the payer signature. An endorsement is recorded on the back 4*b* of the check 4.

Internal Construction

Figure 3:
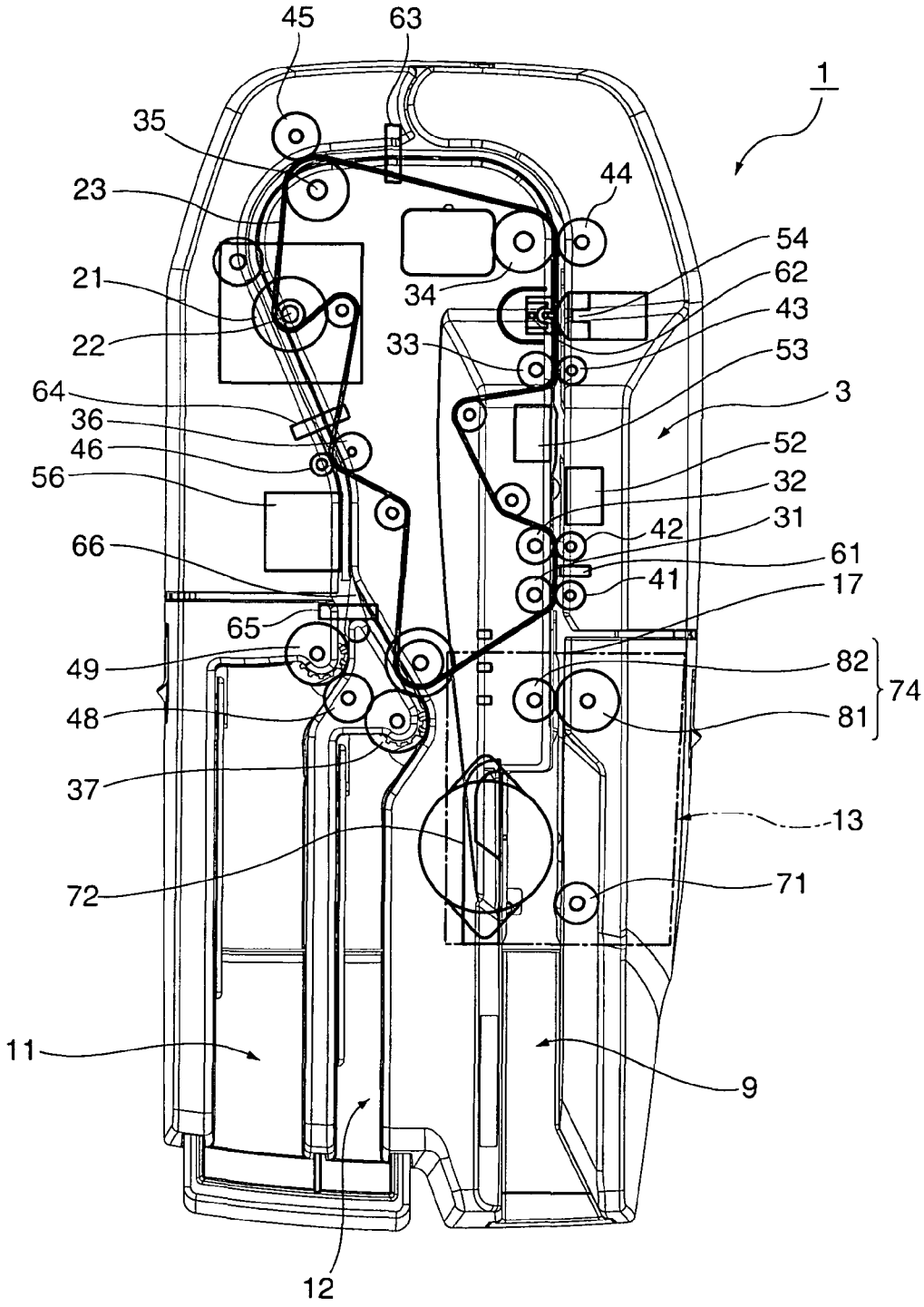
FIG. 3 describes the internal configuration of the check processing device shown in FIG. 1.

FIG. 3 describes the internal configuration of the check processing device 1 in relationship to the transportation mechanism.

A check separating and feeding mechanism 13 for feeding the checks 4 loaded in a bunch into the check loading unit 9 one at a time into the check transportation path 5 is disposed to the check loading unit 9. The check loading unit 9 and the check separating and feeding mechanism 13 are described in detail below.

The transportation mechanism for conveying the checks 4 fed one at a time from the check loading unit 9 along the check transportation path 5 includes a transportation motor 21, a drive pulley 22 mounted on the rotating shaft of the transportation motor 21, a set of transportation rollers 31 to 36 disposed along the check transportation path 5, and a set of pressure rollers 41 to 46 that are pressed against and rotate in conjunction with the transportation rollers 31 to 36. A discharge roller 37 feeds checks into the second check discharge unit 12, and rotation of the discharge roller 37 is transferred by a transfer gear 48 to a discharge roller 49 for feeding checks into the first check discharge unit 11. An endless belt 23 transfers rotation of the transportation motor 21 to the transportation rollers 31 to 36.

The transportation rollers 31 and 32 are disposed at the upstream end of the upstream-side transportation path portion 6, and transportation roller 33 is disposed approximately in the middle of the upstream-side transportation path portion 6, and transportation roller 34 is disposed near where the upstream-side transportation path portion 6 connects to the curved transportation path portion 7. Transportation roller 35 is located on the downstream side of the curved transportation path portion 7. Transportation roller 36 is in the middle of the downstream-side transportation path portion 8, and discharge roller 37 is located at the discharge opening into the second check discharge unit 12. Discharge roller 49 is disposed at the discharge opening into the first check discharge unit 11.

A front contact image sensor 52 is disposed as the front image scanner, and a back contact image sensor 53 is disposed as a back image scanner, between the transportation rollers 32 and 33. A magnetic head 84 for magnetic ink character reading is disposed between transportation rollers 33 and 34.

A print mechanism 56 is disposed on the downstream side of the transportation roller 36 in the downstream-side transportation path portion 8. The print mechanism 56 can move between a printing position applying pressure-to the check 4 and a standby position retracted from this printing position by means of a drive motor (not shown in the figure). The print mechanism 56 can also be rendered as a stamp mechanism that is pushed by a plunger to print (stamp) the check 4.

Various sensors for check transportation control are also disposed to the check transportation path 5.

A paper length detector 61 for detecting the length of the conveyed check 4 is located between transportation rollers 31 and 32.

A multifeed detector 62 for detecting if two or more checks 4 are being fed together (also referred to as a multifeed condition) is located opposite the magnetic head 54.

A jam detector 63 is located at a position on the upstream side of the transportation roller 35. A check is known to be jammed in the check transportation path 5 if the jam detector 63 detects a check 4 continuously for a prescribed time or longer.

A print detector 64 for detecting the presence of a check 4 printed by the print mechanism 56 is located on the upstream side before the transportation roller 36.

A discharge detector 65 for detecting the discharged check is disposed to the diversion paths 10*a* and 10*b* where the check transportation path 5 branches to the first and second check discharge units 11 and 12.

A flapper 66 that is driven by a drive motor not shown to switch the discharge path is disposed on the upstream side of the diversion paths 10*a* and 10*b*. The flapper 66 selectively switches the connection of the downstream end of the check transportation path 5 to the first check discharge unit 11 or the second check discharge unit 12, and guides the check 4 to the selected discharge unit.

Check Insertion Unit

Figure 4A:
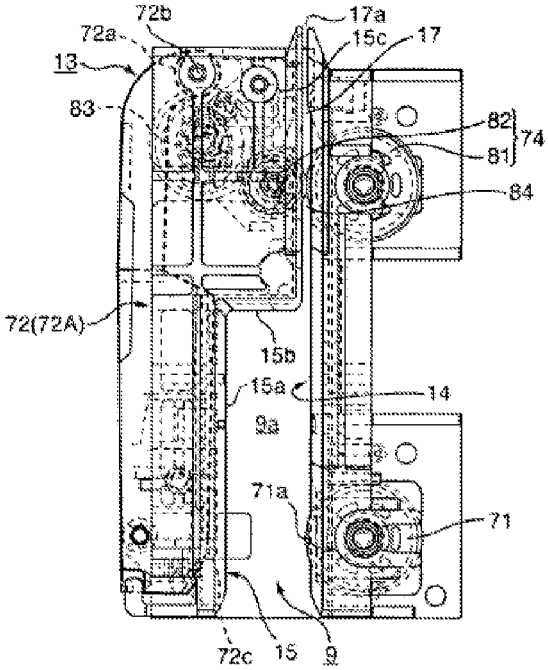
FIG. 4A is a schematic diagram of the check loading unit and the check separating and feeding mechanism when the pressure member 72 is retracted from the check loading unit 9.
Figure 4B:
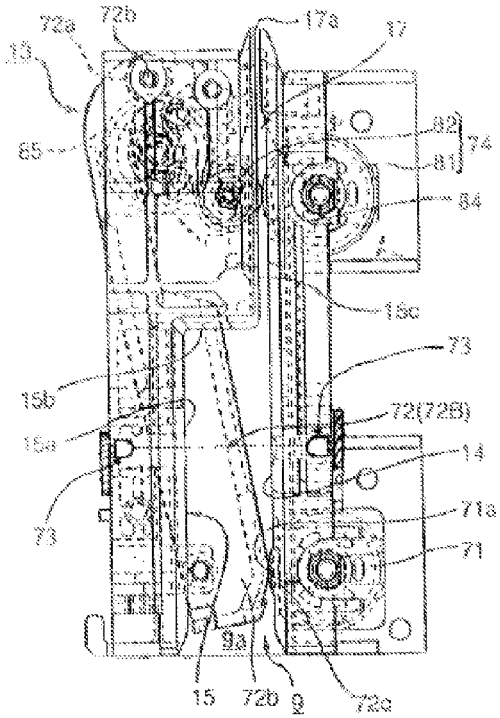
FIG. 4B is a schematic diagram of the check loading unit and the check separating and feeding mechanism when the pressure member 72 is in the working position inside the check loading unit 9.

FIG. 4A and FIG. 4B are schematic diagrams of the check loading unit 9 and the check separating and feeding mechanism 13. The configuration of the check loading unit 9 is described first with reference to FIG. 1, FIG. 4A, and FIG. 4B.

The check loading unit 9 is basically defined by a pair of right and left guide surfaces, first guide surface 14 and second guide surface 15, and a bottom 16. The first guide surface 14 is a straight, flat vertical surface. The second guide surface 15 includes a parallel guide surface part 15*a*, a perpendicular guide surface part 15*b*, and a feed-side parallel guide surface part 15*c*. The parallel guide surface part 15*a* is parallel to and separated a constant distance from the first guide surface 14. The perpendicular guide surface part 15*b* bends at an angle of substantially 90 degrees from the downstream end of the parallel guide surface part 15*a* towards the first guide surface 14. The feed-side parallel guide surface part 15*c* continues from the first guide surface 14 side end of the perpendicular guide surface part 15*b* and extends downstream parallel to the first guide surface 14 with a narrow gap therebetween.

The parallel guide surface part 15*a* of the second guide surface 15 and the opposing part of the first guide surface 14 render a wide check storage part 9*a* into which the checks 4 are loaded. The width at the inside (downstream) end of the check storage part 9*a* is narrowed by the perpendicular guide surface part 15*b*. The feed-side parallel guide surface part 15*c* and the opposing part of the first guide surface 14 define the check infeed path 17 of a constant narrow width continuing from the downstream end of the check storage part 9*a*. The downstream end of the check infeed path 17 is the check supply opening 17*a* that communicates with the check transportation path 5.

Check Separating and Feeding Mechanism

The check separating and feeding mechanism 13 is described next with reference primarily to FIG. 4A and FIG. 4B. The check separating and feeding mechanism 13 has a feed roller 71 for feeding the checks 4, a pressure member 72 for pressing the checks 4 to the feed roller 71, and a separating mechanism 74. The separating mechanism 74 feeds the checks 4 advanced to the check infeed path 17 by the feed roller 71 one at a time to the check transportation path 5.

The feed roller 71 is located approximately in the middle of the first guide surface 14 in the check transportation direction, and the outside surface 71*a* of the feed roller 71 protrudes slightly from the first guide surface 14 into the check loading unit 9. A window 15*d* (see FIG. 1) is formed in the parallel guide surface part 15*a* of the second guide surface 15 opposite the feed roller 71. The pressure member 72 enters and leaves the check storage part 9*a* of the check loading unit 9 through this window 15*d*.

The pressure member 72 is supported so that its base end 72*a* can pivot on the support shaft 72*b*, and a pressure surface 72*c* is formed on the distal end. When the pressure member 72 pivots on the support shaft 72*b* and rotates from the standby position 72A shown in FIG. 4A into the check storage part 9*a*, the pressure member 72 can pivot until the pressure surface 72*c* advances into the check storage part 9*a* and is pressed to the feed roller 71 at the pressure position 72B shown in FIG. 4B.

FIG. 4B shows the pressure member 72 pressed to the feed roller 71. When checks 4 are loaded into the check storage part 9*a*, the checks 4 are pressed to the feed roller 71 by the pressure member 72. When the feed roller 71 then turns, the check 4 in contact with the feed roller 71 is advanced into the check infeed path 17 and supplied through the check infeed path 17 to the check transportation path 5.

The standby position 72A of the pressure member 72 is detected by a sensor (not shown in the figure) such as a mechanical switch attached on the main unit side.

The operation of pressing the pressure member 72 to the checks 4 in the check loading unit 9 is enabled when a check 4 is detected by a transmission type optical sensor 73 disposed in the check loading unit 9. If a check 4 is detected, the pressure member 72 pivots toward the feed roller 71 from the standby position 72A so that the check 4 is pressed to the feed roller 71 in response to a command from a host computer 103 (see FIG. 8) that is connected to the check processing device 1, or a command input manually using a switch, for example.

The separating mechanism 74 is a retard roller separation mechanism disposed to the middle part of the check infeed path 17, and includes a separation roller 81 on the first guide surface 14 side and a retard roller 82 on the opposite side of the check infeed path 17. The retard roller 82 is pressed with a predetermined amount of pressure to the outside of the separation roller 81. A torque limiter 83 applies a predetermined load torque to the retard roller 82 in the check feeding direction. A check 4 advanced by the feed roller 71 into the check infeed path 17 is gripped at the nipping part 84 of the separation roller 81 and retard roller 82, separated from any other checks that are advanced with the check 4 and fed one at a time to the check supply opening 17*a*.

Power Transfer Mechanism for the Check Separating and Feeding Mechanism

Figure 5A:
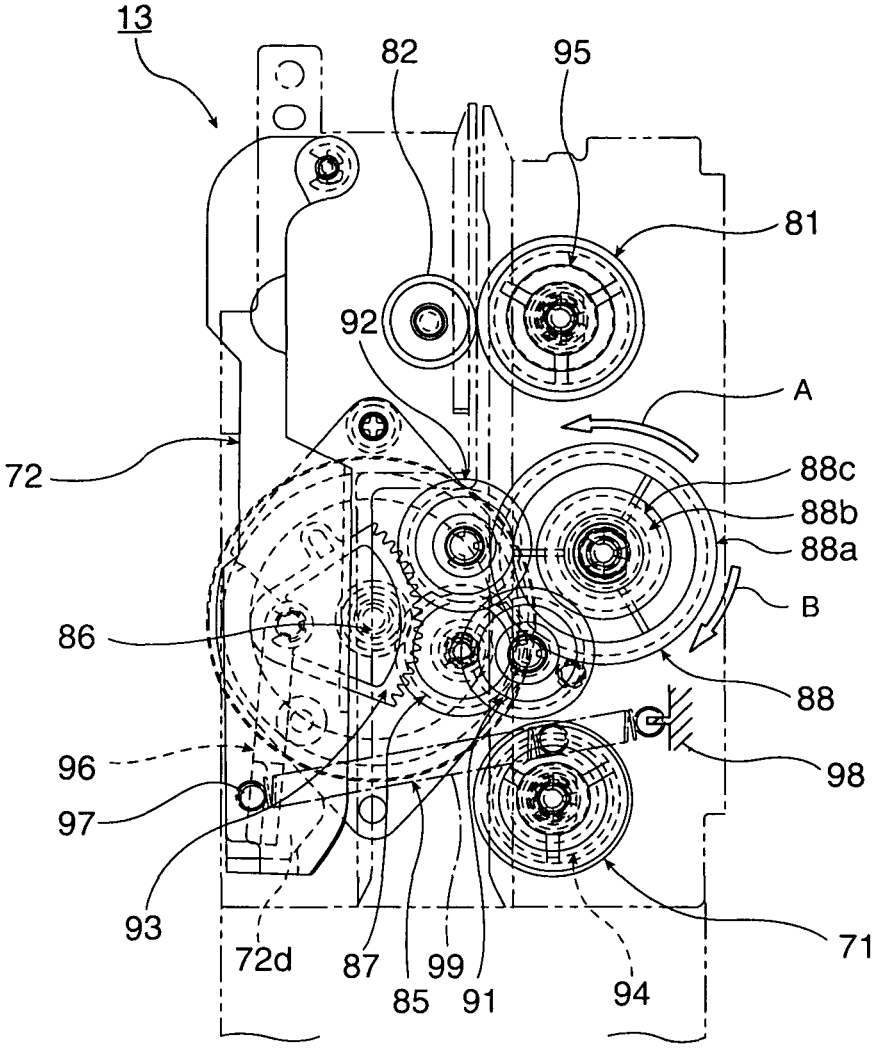
FIG. 5A shows the pressure member drive system.
Figure 5B:
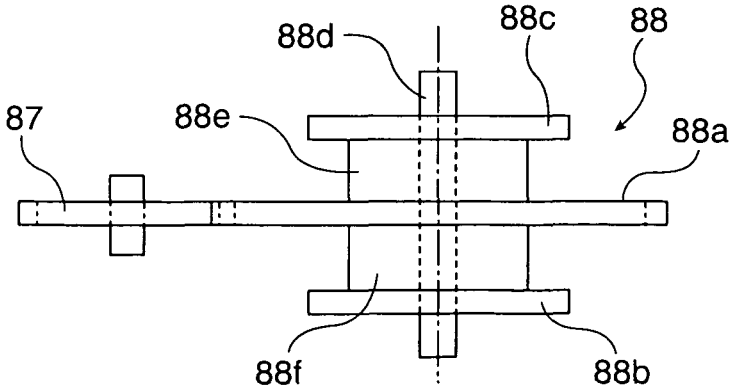
FIG. 5B shows the first one-way clutch mechanism 88*e* and the second one-way clutch mechanism 88*f*.
Figure 6:
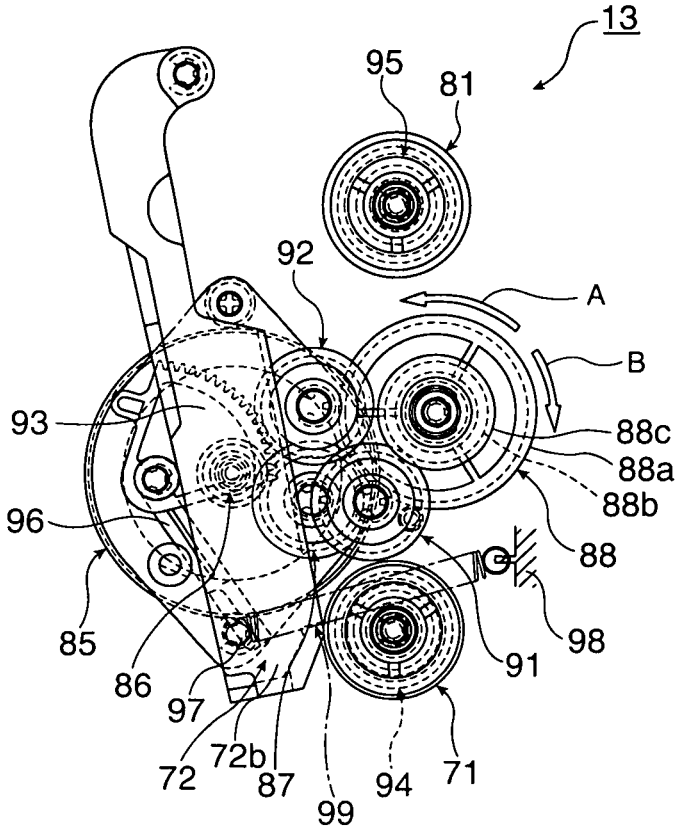
FIG. 6 shows the pressure member drive system.
Figure 7:
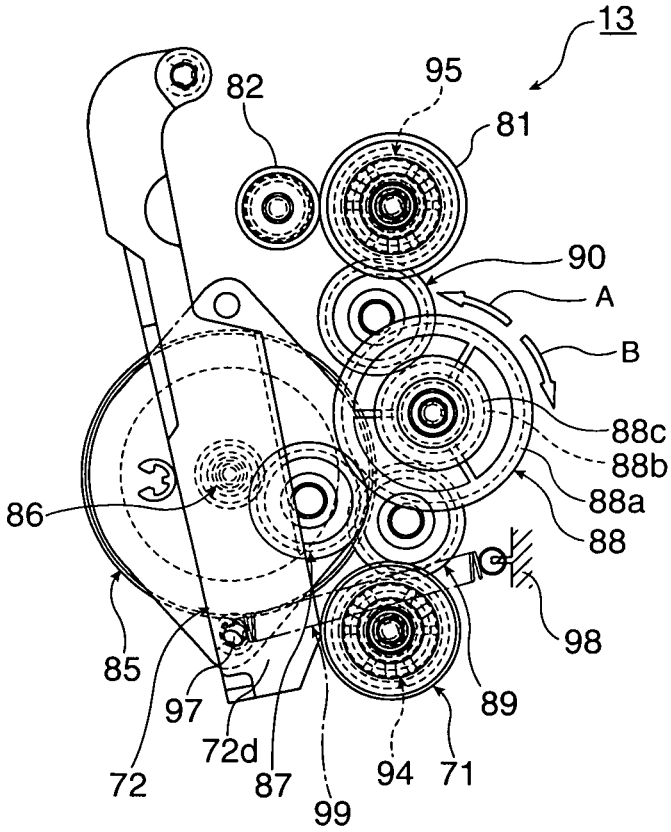
FIG. 7 shows the drive system for the feed roller and the separation roller.

FIG. 5A, FIG. 5B, and FIG. 6 describe the mechanism for driving the pressure member 72 of the check separating and feeding mechanism 13. FIG. 5A shows the pressure member 72 at the standby position 72A, and FIG. 6 shows the pressure member 72 advanced to the pressure position 72B. FIG. 7 shows the mechanism for driving the feed roller 71 and the separation roller 81 of the check separating and feeding mechanism 13. The mechanisms that drive the feed roller 71, the pressure member 72, and the separation roller 81 are described next with reference to these figures.

The check separating and feeding mechanism 13 uses a single drive motor 85 to drive the feed roller 71, the pressure member 72, and the separation roller 81. Torque from the drive motor 85 is selectively transferred according to the direction of rotation through a gear train to the feed roller 71 and separation roller 81 or to the pressure member 72. This gear train includes a drive gear 86 attached to the rotating shaft of the drive motor 85, a transfer gear 87, a compound transfer gear 88, a feed-roller-side transfer gear 89 (see FIG. 7), a separation-roller-side transfer gear 90 (see FIG. 7), a pair of mutually engaged pressure-member-side transfer gears 91 and 92 (see FIG. 5A, FIG. 6), and fan-shaped rocking gear 93 (see FIG. 5A, FIG. 6) that has external teeth formed along an arc of a predetermined angle.

The transfer gear 87 engages the drive gear 86 of the drive motor 85, and meshes with the large diameter gear 88*a* of the compound transfer gear 88. The compound transfer gear 88 has a large diameter gear 88*a*, and a roller-side small diameter gear 88*b* and pressure-member-side small diameter gear 88*c* disposed coaxially on opposite sides of the large diameter gear 88*a*. As shown in FIG. 7, the roller-side small diameter gear 88*b* of the compound transfer gear 88 meshes with the feed-roller-side transfer gear 89 and the separation-roller-side transfer gear 90. The feed-roller-side transfer gear 89 engages the follower 94 attached to the shaft of the feed roller 71, and the separation-roller-side transfer gear 90 engages the follower 95 attached to the shaft of the separation roller 81.

As shown in FIG. 5A, FIG. 5B, and FIG. 6, the pressure-member-side small diameter gear 88*c* part of the compound transfer gear 88 engages the pressure-member-side transfer gear 91. The other pressure-member-side transfer gear 92 that is engaged with pressure-member-side transfer gear 91 meshes with the rocking gear 93. The inside end part of the straight rocking lever 96 is coupled to the rocking gear 93 at the pivot axis of the rocking gear 93, and the rocking lever 96 extends radially to the outside.

The distal end part of the rocking lever 96 is attached to the distal end 72*d* of the pressure member 72 by a connector pin 97 on the opposite side as the check storage part 9*a*. A tension spring 99 connects the connector pin 97 with a spring catch 98 disposed on the feed roller 71 side of the check loading unit 9. The tension spring 99 constantly urges the pressure member 72 into the check storage part 9*a*, and the connector pin 97 is held pressed to the distal end part of the rocking lever 96.

As shown in FIG. 5B the large diameter gear 88*a* is fixed to the gear shaft 88*d* of the compound transfer gear 88. The pressure-member-side small diameter gear 88*c* and the roller-side small diameter gear 88*b* are respectively linked through a first one-way clutch mechanism 88*e* and a second one-way clutch mechanism 88*f* to the large diameter gear 88*a* and the gear shaft 88*d*.

The first one-way clutch mechanism 88*e* engages and causes the pressure-member-side small diameter gear 88*c* to rotate in unison with the large diameter gear 88*a* when the large diameter gear 88*a* rotates in a first direction indicated by arrow A in FIG. 5 to FIG. 7. When the large diameter gear 88*a* rotates in the opposite second direction indicated by arrow B, the first one-way clutch mechanism 88*e* causes the pressure-member-side small diameter gear 88*c* to disengage the large diameter gear 88*a*.

The second one-way clutch mechanism 88*f* disengages the roller-side small diameter gear 88*b* from the large diameter gear 88*a* when the large diameter gear 88*a* rotates in the first direction indicated by arrow A, and causes the roller-side small diameter gear 88*b* to engage and rotate in unison with the large diameter gear 88*a* when it rotates in the second direction indicated by arrow B.

The first one-way clutch mechanism 88*e* and the second one-way clutch mechanism 88*f* are attached to the gear shaft 88*d* of the large diameter gear 88*a* and are connected to the large diameter gear 88*a*. The first one-way clutch mechanism 88*e* and second one-way clutch mechanism 88*f* are on opposite sides of the large diameter gear 88*a*. This configuration affords a compact compound transfer gear 88.

The first one-way clutch mechanism 88*e* can alternatively be disposed to one of the pressure-member-side transfer gears 91 and 92. The second one-way clutch mechanism 88*f* can alternatively be disposed to the feed-roller-side transfer gear 89 and separation-roller-side transfer gear 90, or to the roller holder part of the feed roller 71 or the roller holder part of the separation roller 81.

Operation of the Check Separating and Feeding Mechanism

The operation of the check separating and feeding mechanism 13 is described next with reference to FIG. 4 to FIG. 7.

When a bunch of checks 4 is loaded into the check loading unit 9 when the pressure member 72 is in the standby position 72A as shown in FIG. 4A and FIG. 5A, a sensor 73 detects that checks 4 were loaded. An appropriate command that is asserted manually or from the host device then causes the drive motor 85 to operate. When the drive motor 85 turns clockwise as shown in FIG. 5A, the large diameter gear 88*a* rotates in the second direction (in the direction of arrow B).

Rotation of the drive motor 85 in this second direction is transferred to the drive gear 86, the transfer gear 87, and the large diameter gear 88*a* of the compound transfer gear 88. As shown in FIG. 7, torque transferred to the large diameter gear 88*a* is passed through the second one-way clutch mechanism 88*f* and roller-side small diameter gear 88*b* to the feed-roller-side transfer gear 89 and separation-roller-side transfer gear 90, and thereby to the follower 94 of the feed roller 71 and the follower 95 of the separation roller 81. This causes the feed roller 71 and the separation roller 81 to start rotating in the check 4 feeding direction.

Torque in the second direction transferred to the large diameter gear 88*a* of the compound transfer gear 88 is not transferred by the first one-way clutch mechanism 88*e* to the pressure-member-side small diameter gear 88*c*. More specifically, the first one-way clutch mechanism 88*e* interrupts the power transfer path to the pressure member 72 and the pressure-member-side small diameter gear 88*c* turns freely.

This operation releases the constraining force holding the pressure member 72 in the standby position 72A. Because the pressure member 72 is constantly pulled by the tension spring 99 to the feed roller 71 side, the tension of the spring pulls the pressure member 72 to the feed roller 71 as shown in FIG. 6 and FIG. 7 and thereby presses the checks 4 to the feed roller 71. This pivoting of the pressure member 72 causes the rocking lever 96 to pivot in unison therewith and causes the rocking gear 93 connected to the inside end of the rocking lever 96 to turn.

Rotation of the feed roller 71 then conveys the check 4 pressed thereto into the nipping part 84 of the separation roller 81 and retard roller 82 whereby the checks 4 are separated and fed one at a time to the check supply opening 17*a*.

When the detector 73 detects that there are no checks 4 in the check loading unit 9, the drive motor 85 changes direction and turns in the opposite direction, that is, counterclockwise, as shown in FIG. 6, causing the large diameter gear 88*a* to rotate in the first direction in the direction of arrow A. In this case, as shown in FIG. 6 and FIG. 7, torque from the drive motor 85 is transferred from the drive gear 86 and transfer gear 87 to the large diameter gear 88*a* of the compound transfer gear 88, through the first one-way clutch mechanism 88*e* to the pressure-member-side small diameter gear 88*c*, and then through the pressure-member-side transfer gears 91, 92 to the rocking gear 93. This causes the rocking gear 93 to rotate from the position shown in FIG. 6 to the position shown in FIG. 5A. The rocking lever 96 that pivots in unison with the rocking gear 93 thus pushes the pressure member 72 back to the standby position 72A as shown in FIG. 4A and FIG. 5A. When the detector not shown detects that the pressure member 72 has returned to the standby position 72A, the drive motor 85 stops.

When the pressure member 72 is being returned to the standby position 72A, the feed roller 71 and separation roller 81 do not turn. More specifically, the second one-way clutch mechanism 88*f* interrupts the transfer of drive power to the feed roller 71 and separation roller 81 and thus stops rotation of these rollers 71 and 81.

As described above, the check separating and feeding mechanism 13 according to this embodiment of the invention drives the pressure member 72 and the feed roller 71 and separation roller 81 using a single drive motor 85. The size of the drive mechanism can thus be reduced compared with a configuration that uses separate drive motors.

In addition, driving the pressure member 72 and driving rotation of the rollers 71 and 81 is switched according to the direction of drive motor 85 rotation by means of the first one-way clutch mechanism 88*e* and second one-way clutch mechanism 88*f* disposed to the drive power transfer path. Because these one-way clutches 88*e* and 88*f* can be assembled coaxially to the compound transfer gear 88, the transfer mechanism that switches the drive power transfer path according to the direction of rotation can be rendered small and compact. This reduces the amount of required installation space and helps reduce device size.

This embodiment of the invention also uses the second one-way clutch mechanism 88*f* to prevent the rollers 71 and 81 from rotating in reverse. This prevents such problems as a check 4 that is left in the check loading unit 9 being fed in reverse so that it falls out from the opening to the check loading unit 9 and becomes lost.

The foregoing embodiment of the invention is used as a check separating and feeding mechanism in a check processing device. The media separating and feeding device of at least one embodiment of the invention can, however, be used in devices other than check processing devices that process sheet media, including printers, scanners, and MICR readers.

Control System of the Check Processing Device

Figure 8:
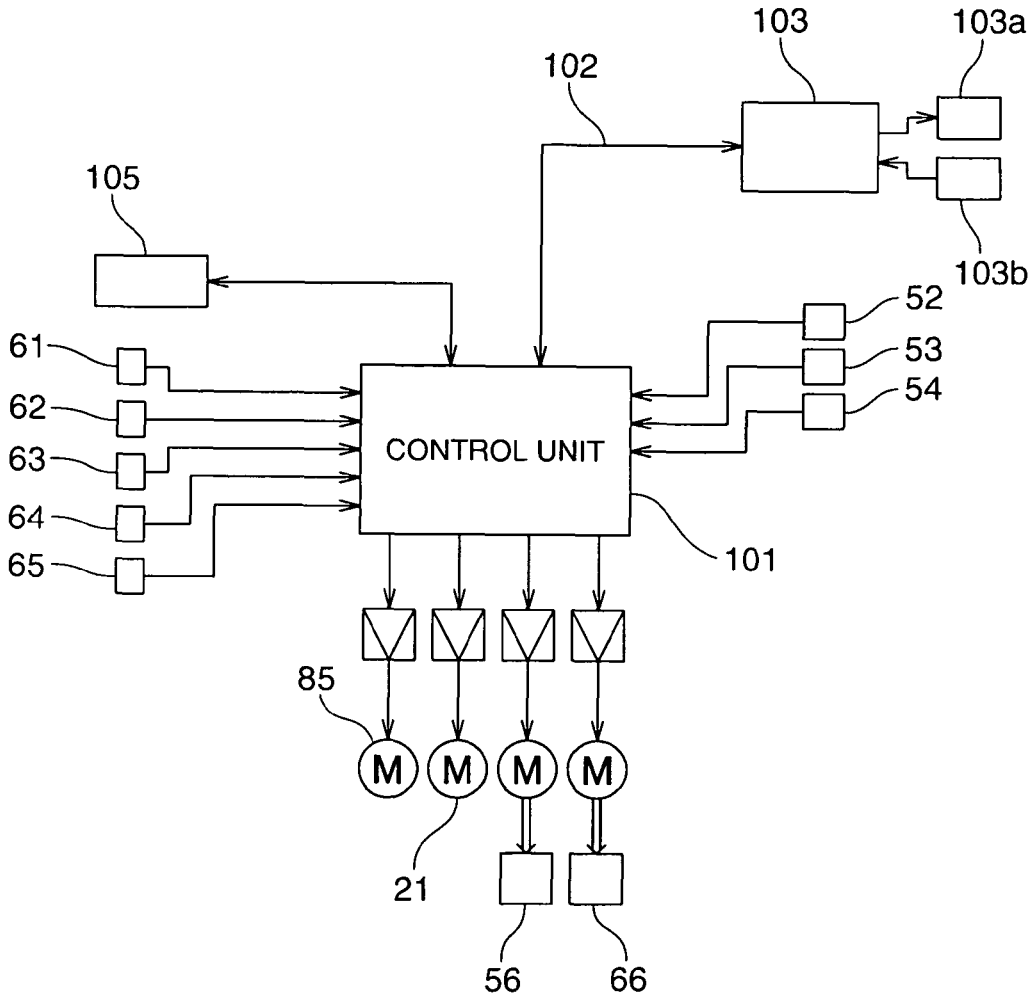
FIG. 8 is a block diagram of the control system of the check processing device.

FIG. 8 is a block diagram showing the control system of the check processing device 1 described above. The control system of this check processing device 1 includes a control unit 101 that is built around a CPU and includes ROM and RAM. The control unit 101 is connected to a host computer 103 by means of a communication cable 102. The host computer 103 includes a display device 103*a* and input/output devices such as a keyboard, mouse, or other operating unit 103*b*. Commands, such as a start command for the check reading operation are input from the host computer 103 to the control unit 101.

When the control unit 101 receives a start reading command, the drive motor 85 and transportation motor 21 are driven to feed the checks 4 one at a time into the check transportation path 5, and the checks 4 are then conveyed through the check transportation path 5. Images of the front and back of each check 4 and the magnetic ink character information captured by the front contact image scanner 52, the back contact image scanner 53, and the magnetic head 54 are input to the control unit 101. This information is then supplied to the host computer 103 which processes the images and runs a character recognition process, determines if the check 4 was read correctly, and returns the result of this decision to the control unit 101. Based on this result, the control unit 101 controls driving the print mechanism 56 and the flapper 66.

The control unit 101 controls conveying the checks 4 based on detection signals from a paper length detector 61, a multifeed detector 62, a paper jam detector 63, a print detector 64, and a discharge detector 65 disposed along the check transportation path 5. An operating unit 105 that includes operating switches such as a power switch and is disposed to the bottom case 2 is also connected to the control unit 101.

Check Processing Operation

Figure 9:
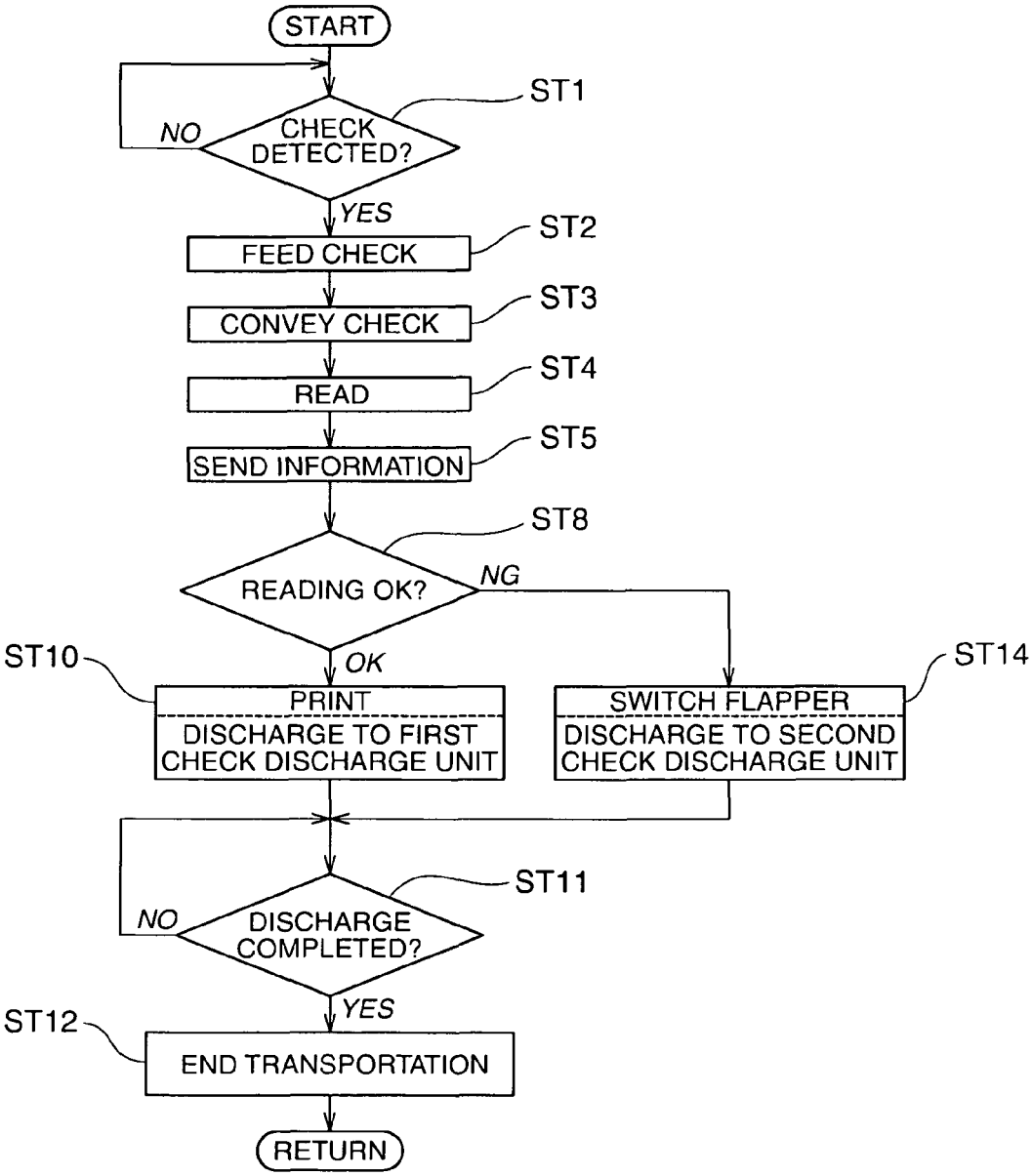
FIG. 9 is a flow chart describing the check processing operation of the check processing device.

FIG. 9 is a flow chart describing the processing operation of the check processing device 1.

When the operator inputs a start reading command from the operating unit 103*b* of the host computer 103 and the sensor detects that checks 4 have been loaded, the drive motor 85 causes the feed roller 71 to turn and causes the pressure member 72 to move and press the checks 4 to the feed roller 71. The checks 4 are thus fed by the feed roller 71. The transportation motor 21 also operates and causes the transportation rollers 31 to 36 to rotate. The checks 4 fed into the check infeed path 17 are separated and fed one at a time by the separating mechanism 74 disposed to the check infeed path 17 into the check transportation path 5 (steps ST1 and ST2).

The supplied checks 4 are then sequentially conveyed by the transportation rollers 31 to 36 along the check transportation path 5 (step ST3). The front and back of the conveyed checks 4 are imaged and the MICR line is read by the front contact image scanner 52, the back contact image scanner 53, and the magnetic head 54, respectively, as each check 4 passes by (step ST4).

The captured information is then passed over the communication cable 102 to the host computer 103 (step ST5). The host computer 103 processes the captured front and back images and the magnetic ink character information, and decides if the check was read correctly. A read error results if a check 4 is conveyed upside down because the magnetic ink characters cannot be read. A read error also results if a check 4 is conveyed with the front and back reversed because the magnetic ink characters cannot be read. A read error may also result if a part of the magnetic ink character information cannot be read because the check 4 is folded, torn, or skewed during transportation. A read error may also result if the check amount or other necessary information cannot be read from the front and back check images because the check 4 is folded, torn, or skewed during transportation.

If the check was read correctly, the print mechanism 56 is moved to the printing position (step ST8, ST10). The print mechanism 56 prints an endorsement or other information on the check 4 as the check 4 passes by, and the check 4 is then directed by the flapper 66 into the first check discharge unit 11

(step ST10). When the discharge detector 65 detects the trailing end of the check 4, transportation stops (step ST11, ST12).

If a read error is returned or the check cannot be read (step ST8), the flapper 66 switches (step ST14). The print mechanism 56 is held in the standby position and the check 4 is not printed. The check 4 is then directed into the second check discharge unit 12 by the flapper 66 (step ST14). When the discharge detector 65 detects the trailing end of the check 4, transportation stops (step ST11, ST12).

If the multifeed detector 62 detects multifeed checks, an interrupt process immediately stops check transportation, a check feed error is reported by means of a warning indicator on the operating unit 105, for example, and operation then waits until the check is removed from the check transportation path 5 and operation is reset. A similar interrupt process also runs if the paper jam detector 63 detects that a check is jammed in the check transportation path 5.

Although at least one embodiment of the present invention has been described in connection with the preferred embodiments thereof with reference to the accompanying drawings, it is to be noted that various changes and modifications will be apparent to those skilled in the art. Such changes and modifications are to be understood as included within the scope of at least one embodiment of the present invention as defined by the appended claims, unless they depart therefrom.

What is claimed is:

1. A media separating and feeding mechanism comprising:

a feed roller for feeding sheet media, the feed roller protruding from a guide surface for guiding media in a feeding direction;

a pressure member for pressing the sheet media towards the feed roller and the guide surface;

a separation roller for separating and feeding the sheet media fed by the feed roller, said separation roller being located downstream of said feed roller;

a single drive motor for driving the feed roller, separation roller, and pressure member;

a drive power transfer mechanism for transferring torque from the drive motor to the feed roller, separation roller, and pressure member;

a loading unit configured to receive sheet media loaded therein, the guide surface defining a surface of the loading unit; and a sensor configured to detect presence of sheet media within the loading unit, wherein the drive power transfer mechanism selectively switches between transferring torque to the feed roller and separation roller, and transferring torque to the pressure member, according to a direction of drive motor rotation, wherein the direction of drive motor rotation is based on whether any sheet media is present between the pressure member and the feed roller, wherein when the sensor detects presence of sheet media within the loading unit, the drive motor moves in a direction to transfer torque to the feed roller and separation roller, and wherein when the sensor detects that sheet media is not present within the loading unit, the drive motor moves in a direction to transfer torque to the pressure member.

2. The media separating and feeding mechanism according to claim 1, wherein:

the drive power transfer mechanism includes a first one-way clutch that transfers drive motor torque to the pressure member only when the drive motor turns in a first direction.

3. A media processing device comprising:

a media separating and feeding mechanism for separating and advancing sheet media that are inserted in a group to the processing device;

a media transportation path that conveys sheet media by the media separating and feeding mechanism; and a processing unit that executes at least one of a reading process that reads information from the sheet media conveyed through the transportation path, and a printing process that prints on the sheet media;

wherein the media separating and feeding mechanism is the media separating and feeding mechanism according to claim 1.

4. The media separating and feeding mechanism according to claim 1, wherein the pressure member has a standby position in which the pressure member does not press the sheet media towards the feed roller and the guide surface.

5. The media separating and feeding mechanism according to claim 1, wherein the pressure member does not apply pressure toward the feed roller and the surface without sheet media being present between the pressure member and the feed roller.

6. A media separating and feeding mechanism comprising:

a feed roller for feeding sheet media, the feed roller protruding from a guide surface for guiding media in a feeding direction;

a pressure member for pressing the sheet media towards the feed roller side and the guide surface;

a separation roller for separating and feeding the sheet media fed by the feed roller, said separation roller being located downstream of said feed roller;

a sensor configured to detect presence of sheet media between the pressure member and the feed roller;

a single drive motor for driving the feed roller, separation roller, and pressure member; and a drive power transfer mechanism for transferring torque from the drive motor to the feed roller, separation roller, and pressure member;

wherein the drive power transfer mechanism has a first one-way clutch that transfers drive motor torque to the pressure member only when the drive motor turns in a first direction, and a second one-way clutch that transfers drive motor torque to the feed roller and separation roller only when the drive motor turns in a second direction opposite of the first direction, wherein the drive motor turns in the second direction if any sheet media is present between the pressure member and the feed roller, and the drive motor turns in the first direction if any sheet media is not present between the pressure member and the feed roller, and wherein the pressure member moves towards the feed roller and the guide surface when the sensor detects the presence of the sheet media between the pressure member and the feed roller, and the pressure member moves away from the feed roller and the guide surface when the sensor detects no sheet media as being present between the pressure member and the feed roller.

7. The media separating and feeding mechanism according to claim 6, wherein:

the first one-way clutch and the second one-way clutch are rendered with a common shaft.

8. The media separating and feeding mechanism according to claim 6, further comprising:

an urging member that urges the pressure member toward the feed roller;

wherein when the drive motor turns in the second direction, the pressure member is disengaged from the drive power transfer mechanism by the first one-way clutch and is pressed toward the feed roller by the urging force of the urging member, and when the drive motor turns in the first direction, the pressure member is connected to the drive power transfer mechanism by the first one-way clutch and pulled back by the torque of the drive motor in the direction separating from the feed roller.

9. A media processing device comprising:

a media insertion unit in which sheet media are inserted;

a media separating and feeding mechanism for separating and advancing sheet media that are inserted in a group to the media insertion unit;

a media transportation path that conveys sheet media fed from the media insertion unit by the media separating and feeding mechanism; and a processing unit that executes at least one of a reading process that reads information from the sheet media conveyed through the transportation path, and a printing process that prints on the sheet media;

wherein the media separating and feeding mechanism is the media separating and feeding mechanism according to claim 4.

10. The media separating and feeding mechanism according to claim 6, wherein the first one-way clutch transfers drive motor torque to the feed roller and separation roller if the sheet media is present between the pressure member and the feed roller, and the first one-way clutch transfers drive motor torque to the pressure member if the sheet media is not present between the pressure member and the feed roller.

11. The media separating and feeding mechanism according to claim 6, wherein the pressure member has a standby position in which the pressure member does not press the sheet media towards the feed roller and the guide surface.

12. The media separating and feeding mechanism according to claim 6, wherein the pressure member does not apply pressure toward the feed roller and the surface without the sensor detecting the presence of sheet media between the pressure member and the feed roller.

13. A media separating and feeding mechanism comprising:

a feed roller for feeding sheet media, the feed roller protruding from a guide surface for guiding media in a feeding direction;

a pressure member for pressing the sheet media towards the feed roller side and the guide surface;

a separation roller for separating and feeding the sheet media fed by the feed roller, said separation roller being located downstream of said feed roller;

a single drive motor for driving the feed roller, separation roller, and pressure member;

a drive power transfer mechanism for transferring torque from the drive motor to the feed roller, separation roller, and pressure member;

a loading unit configured to receive sheet media loaded therein, the guide surface defining a surface of the loading unit; and a sensor configured to detect presence of sheet media within the loading unit, wherein the drive power transfer mechanism has a first one-way clutch that transfers drive motor torque to the pressure member only when the drive motor turns in a first direction, and a second one-way clutch that transfers drive motor torque to the feed roller and separation roller only when the drive motor turns in a second direction opposite of the first direction, wherein the drive motor turns in the second direction if any sheet media is present between the pressure member and the feed roller, and the drive motor turns in the first direction if any sheet media is not present between the pressure member and the feed roller, wherein when the sensor detects presence of sheet media within the loading unit, the drive motor turns in the second direction, and wherein when the sensor detects that sheet media is not present within the loading unit, the drive motor moves in the first direction.

14. A media separating and feeding mechanism comprising:

a feed roller for feeding sheet media, the feed roller protruding from a guide surface for guiding media in a feeding direction;

a pressure member for pressing the sheet media towards the feed roller and the guide surface; a separation roller for separating and feeding the sheet media fed by the feed roller, said separation roller being located downstream of said feed roller;

a sensor configured to detect presence of sheet media between the pressure member and the feed roller;

a single drive motor for driving the feed roller, separation roller, and pressure member; and a drive power transfer mechanism for transferring torque from the drive motor to the feed roller, separation roller, and pressure member;, wherein the drive power transfer mechanism selectively switches between transferring torque to the feed roller and separation roller, and transferring torque to the pressure member, according to a direction of drive motor rotation, wherein the direction of drive motor rotation is based on whether any sheet media is present between the pressure member and the feed roller, and wherein the drive motor transfers torque to the feed roller and the separation roller if the sensor detects the presence of sheet media between the pressure member and the feed roller, and the drive motor transfers torque to the pressure member if the sensor detects that sheet media is not present between the pressure member and the feed roller.

15. A media separating and feeding mechanism comprising a feed roller for feeding sheet media, the feed roller protruding from a guide surface for guiding media in a feeding direction;

a pressure member for pressing the sheet media towards the feed roller and the guide surface;

a separation roller for separating and feeding the sheet media fed by the feed roller, said separation roller being located downstream of said feed roller;

a sensor configured to detect presence of sheet media between the pressure member and the feed roller;

a single drive motor for driving the feed roller, separation roller, and pressure member; and a drive power transfer mechanism for transferring torque from the drive motor to the feed roller, separation roller, and pressure member, wherein the drive power transfer mechanism selectively switches between transferring torque to the feed roller and separation roller, and transferring torque to the pressure member, according to a direction of drive motor rotation, wherein the direction of drive motor rotation is based on whether any sheet media is present between the pressure member and the feed roller, and wherein the pressure member moves towards the feed roller and the guide surface when the sensor detects presence of the sheet media between the pressure member and the feed roller, and the pressure member moves away from the feed roller and the guide surface when the sensor detects no sheet media as being present between the pressure member and the feed roller.

* * * * *